US006647843B1

(12) United States Patent
Takasaki et al.

(10) Patent No.: US 6,647,843 B1
(45) Date of Patent: Nov. 18, 2003

(54) METHOD AND APPARATUS FOR CUTTING BELTS FROM A BELT SLEEVE MATERIAL

(75) Inventors: Akihito Takasaki, Takasago (JP); Kenichiroh Kamei, Himeji (JP)

(73) Assignee: Mitsuboshi Belting Ltd., Kobe (JP)

( * ) Notice: Subject to any disclaimer, the term of this patent is extended or adjusted under 35 U.S.C. 154(b) by 424 days.

(21) Appl. No.: 09/048,522

(22) Filed: Mar. 26, 1998

(30) Foreign Application Priority Data

Mar. 27, 1997 (JP) ..... 9-076055

(51) Int. Cl.[7] ..... B26D 7/26
(52) U.S. Cl. ..... 83/72; 83/935
(58) Field of Search ..... 83/935, 72, 74, 83/75.5, 407, 425

(56) References Cited

U.S. PATENT DOCUMENTS

| | | | | | |
|---|---|---|---|---|---|
| 1,611,781 | A | * | 12/1926 | Russel et al. | 83/169 |
| 3,701,186 | A | * | 10/1972 | Kuts | 29/33 A |
| 3,791,243 | A | * | 2/1974 | Holinski | 83/54 |
| 4,248,110 | A | * | 2/1981 | Spivy | 83/53 |
| 4,322,916 | A | * | 4/1982 | Richmond | 51/78 |
| 4,437,371 | A | * | 3/1984 | Howerton et al. | 83/54 |
| 4,488,465 | A | * | 12/1984 | Brand et al. | 83/175 |
| 4,516,451 | A | * | 5/1985 | Takeshita et al. | 83/171 |
| 4,541,317 | A | * | 9/1985 | Van Humbeeck et al. | 83/34 |
| 4,554,850 | A | * | 11/1985 | Edgar et al. | 83/178 |
| 4,587,872 | A | * | 5/1986 | Muller-Erwig | 83/18 |
| 4,644,832 | A | * | 2/1987 | Smith | 83/72 |
| 4,649,780 | A | * | 3/1987 | Takeuchi et al. | 82/48 |
| 4,700,597 | A | * | 10/1987 | Taguchi | 83/13 |
| 4,829,864 | A | * | 5/1989 | Yanagisawa et al. | 83/33 |
| 4,833,957 | A | * | 5/1989 | Lundgren | 83/56 |
| 5,025,593 | A | * | 6/1991 | Kawaguchi et al. | 51/165.77 |
| 5,079,874 | A | * | 1/1992 | Luber | 51/165.77 |
| 5,241,483 | A | * | 8/1993 | Porret et al. | 364/469 |
| 5,327,353 | A | * | 7/1994 | Nagano | 364/474.09 |
| 5,381,342 | A | * | 1/1995 | Noe | 364/474.34 |
| 5,694,821 | A | * | 12/1997 | Smith | 83/13 |
| 5,906,148 | A | * | 5/1999 | Aihara et al. | 83/72 |

FOREIGN PATENT DOCUMENTS

| | | |
|---|---|---|
| JP | 6168331/1994 | 6/1994 |
| JP | 7237094/1995 | 9/1995 |

* cited by examiner

*Primary Examiner*—Allan N. Shoap
*Assistant Examiner*—Stephen Choi
(74) *Attorney, Agent, or Firm*—Wood, Phillips, Katz, Clark & Mortimer

(57) ABSTRACT

A cutting system including a belt sleeve, a support subassembly, a cutting subassembly, an imaging subassembly, and a control system. The imaging subassembly generates an image of the actual lateral relationship between a cutting edge and a predetermined cutting location. The control system a) compares the image of the actual lateral relationship between the cutting edge and the predetermined cutting location to a reference image, b) determines deviation between the actual lateral relationship between the cutting edge and the predetermined cutting location and a preferred lateral relationship between the cutting edge and predetermined cutting location, and generates a signal indicative of the deviation. The signal is processed to reduce the deviation.

12 Claims, 3 Drawing Sheets

METHOD AND APPARATUS FOR CUTTING BELTS FROM A BELT SLEEVE MATERIAL

BACKGROUND OF THE INVENTION

1. Field of the Invention

This invention relates to endless belts and, more particularly, to an apparatus for cutting individual belts from a belt sleeve having alternating ribs and grooves on a surface thereof to produce belts of uniform, predetermined width and cross-sectional configuration. The invention is also directed to a method of cutting the individual belts from the belt sleeve.

2. Background Art

Multi-ribbed V-belts are used in a wide range of devices, such as electric home appliances, information devices, etc. A typical multi-ribbed V-belt construction is shown in FIG. 6 herein at 10. The belt 10 has a body 12 which is endless in a lengthwise direction, indicated by the double-headed arrow 14. The body 12 has a constant width W between laterally facing side surfaces 16, 18. The body 12 is commonly made from a cast liquid urethane elastomer or a rubber elastomer. The rubber elastomer is generally at least of natural rubber, butyl rubber, styrene-butadiene rubber, chloroprene rubber, hydrogenated nitrile rubber, and alkylated chlorosulfonated polyethylene. The body 12 has embedded therein longitudinally extending load carrying cords 20 which may be made of polyester or nylon fibers to exhibit high strength and low elongation. The load carrying cords 20 are arranged at a suitable pitch between the side surfaces 16, 18.

The belt body 12 has an inside surface 22, through which V-shaped grooves 24 are formed. V-shaped ribs 26 are formed between adjacent grooves 24 in the widthwise direction of the belt 10.

Typically, the multi-ribbed V-belts 10 are constructed with a predetermined groove shape, size, and pitch. As an example, the assignee herein offers multi-ribbed V-belts made of urethane that are sold commercially under the trademarks RIBSTAR U™ and POLYMAX™, which have grooves with a shape and pitch as designated in Table 1, below.

TABLE 1

| Trade-mark | Ribstar U™ | | | Polymax™ | | | |
|---|---|---|---|---|---|---|---|
| Grove Shape | J, JT | JB, JBT, JBF | HB | 3 M | 5 M | 7 M | 11 M |
| Grove Pitch (mm) | 2.34 mm | 2.4 mm | 1.6 mm | 3.0 mm | 5.3 mm | 8.5 mm | 13.2 mm |

The shape and pitch of grooves on multi-ribbed V-belts are designated according to International Standards (ISO-9982), as set out in Table 2, below.

TABLE 2

| Groove Shape | H | J | K | L | M |
|---|---|---|---|---|---|
| Groove Pitch | 1.6 mm | 2.34 mm | 3.56 mm | 4.7 mm | 9.4 mm |

A typical process for manufacturing multi-ribbed V-belts is as follows. Load carrying cords, which may be made from aramid fiber, polyester fiber, or the like, are spirally wound over a cylindrical internal mold which has axially extending ridges formed in the outer circumferential surface thereof at a suitable pitch in the circumferential direction. The internal mold is in turn fit within a cylindrical external mold, with a predetermined clearance maintained therebetween. The external mold has an internal surface with V-shaped grooves extending in a circumferential direction, with the grooves spaced at a predetermined pitch in the axial direction. The space between the external surface of the internal mold and the internal surface of the external mold is filled with a liquid elastomer and is degasified to cause the elastomer to set. The internal and external molds are then separated from each other to produce a belt sleeve having an exposed external surface with alternating ribs and grooves thereon.

Alternatively, the external mold can be made with an internal surface having no grooves formed therein i.e. with a flat surface. The belt sleeve resulting after separation of the internal and external molds can then be ground to produce the alternating ribs and grooves, which are formed by the external mold in the previously described method.

Predetermined widths of the belt sleeve are then serially removed to form individual multi-ribbed V-belts. The apparatus used to effect the cutting of the belt sleeve typically has a cutter which is pushed against the belt sleeve at the exposed surface where the ribs and grooves are formed.

The apparatus is designed to cut the belt sleeve precisely through the base of the V-shaped groove between adjacent ribs. The resulting cut produces side surfaces which each include a flat portion which is orthogonal to the back side surface of the belt and an angled surface portion which is contiguous with the flat surface portion and which projects laterally inwardly with respect to the belt body. If the cut between the adjacent ribs is laterally offset, one of two conditions occurs. First, the cut may be laterally shifted towards the center of the belt, as a result of which the area of the angled surface portion is reduced. This reduces the contact area between that surface portion and a cooperating pulley, potentially detrimentally reducing the overall transmission capability between the belt and cooperating pulley.

With the second condition, a part of the rib laterally outwardly from the outermost rib overhangs the angled surface portion. With this condition, the belt may not properly seat in a cooperating pulley. The overhanging rib portion may ride on top of the pulley so as to potentially cause the belt to disengage from the pulley and/or twist during operation.

In a typical belt construction, lateral shifting simultaneously produces one of these conditions at each lateral side of the belt. Thus, to ensure proper belt operation, it is important to accurately produce multi-ribbed V-belts of the same width and configuration.

In a typical belt cutting apparatus, the cutter is shifted laterally by a distance corresponding to the desired belt width after completion of each cutting operation. This distance is predetermined by the particular belt specification. Typically, manual inspection and adjustment of the cutter is carried out to produce the desired belt width. The groove within which the cut is to be formed, is commonly inspected by an operator using a magnifying glass. An instantaneous decision is made as to the deviation between the cutter location and the base/center line for the groove. The operator makes a quick lateral adjustment to eliminate the deviation between the center line of the groove and the cutting edge of the cutter, whereupon the cutting edge on the cutter is pressed into the belt sleeve material to effect removal of the belt.

In operations where the operator is required to continually inspect and make manual fine adjustments of the cutting edge, the operator may be required to become dedicated to a single task during the cutting operation. This may add significantly to the overall production costs and may adversely effect efficiency.

With this type of apparatus, if there is a deviation between the lateral location of the cutting edge on the cutter and the base of the groove at which a cut is to be made this deviation may recur each time that the cutter is moved after the completion of a cutting operation. In high speed, high production operations, this deviation must be compensated for instantaneously based on a quick visual observation by the operator and with a fine manual adjustment. To successfully make the adjustment both efficiently and accurately, the operator must generally be highly experienced and skilled. However, since the adjustment is based on a visual observation, even the skilled worker may not be able to consistently and effectively finely adjust the cutting edge on the cutter, as required. Inaccurate lateral location of the cutting edge results in the aforementioned problem, wherein one of the side surfaces of the belt has a reduced contact area, while the other side has a partial overhang of a rib portion.

These defects may become even more significant with belts having a groove pitch of 2 mm or less. Further, the defects with belts having a groove pitch of 2 mm or less may be more difficult to prevent. Still further, with these belts having a relatively small groove pitch, deviations from intended locations, even if relatively slight, may significantly affect production yield.

In certain cutting apparatus, the cutter is sequentially slid by the distance equal to the pre-programmed width of the belt being cut. Any deviation from the desired shiffing becomes aggravated by the fact that the error multiplies with each movement of the cutter. After a plurality of lateral movements of the cutter, a significantly greater deviation from the intended cutting location of the cutter edge may result. The deviation may be so significant that manual fine adjustment by the operator may not be sufficient to appropriately reposition the cutter blade. This may necessitate that the entire system be shut down and that more gross adjustments of the cutter be made.

SUMMARY OF THE INVENTION

The invention is directed to a cutting system including a belt sleeve, a support subassembly, a cutting subassembly, an imaging subassembly, and a control system. The belt sleeve has a body with a width between laterally spaced sides and which is to be cut at a predetermined cutting location on the body to form an individual belt. The belt sleeve is trained around the support assembly. The cutting subassembly includes a cutter having a cutting edge to engage and cut the belt sleeve at the predetermined cutting location. The cutting subassembly further has a base element which carries the cutter and which is repositionable to move the cutting edge in a lateral direction relative to the belt sleeve. The imaging subassembly generates an image of the actual lateral relationship between the cutting edge and the predetermined cutting location. The control system a) compares the image of the actual lateral relationship between the cutting edge and the predetermined cutting location to a reference image showing the preferred lateral relationship between the cutting edge and the predetermined cutting location b) determines a deviation between the actual lateral relationship between the cutting edge and the predetermined cutting location and the preferred lateral relationship between the cutting edge and the predetermined cutting location and c) generates a signal indicative of the deviation which can be processed to cause the base element to be repositioned to reduce the deviation between the actual lateral relationship between the cutting edge and the predetermined cutting location and the preferred lateral relationship between the cutting edge and the predetermined cutting location.

The support subassembly may include first and second spaced pulleys around which the belt sleeve is trained and a drive for causing the belt sleeve to move in an endless path around the first and second pulleys.

In one form, the imaging subassembly includes a camera and there is a monitor for displaying the image of the actual lateral relationship between the cutting edge and the predetermined cutting location generated by the camera.

In one form, the camera has an image pickup area with a center line and the cutting edges aligned with the center line of the image pickup area laterally with respect to the belt sleeve.

The cutting subassembly may include at least one cylinder for advancing the cutting edge against and through the belt sleeve.

The cutting edge and camera may be movable as one piece laterally relative to the belt sleeve.

In one form, the belt body has a plurality of ribs including first and second ribs with a V-shaped groove between the first and second ribs. The V-shaped groove has a base/center line which is at the predetermined cutting location.

In one form, the cutting subassembly includes a servomotor operable in a forward direction and a reverse direction to thereby selectively cause the base element to reposition in first and second opposite lateral directions relative to the belt sleeve and the servomotor is operable in response to the signal generated by the control system.

The control system may include a positioning sequencer for generating a signal that causes the servomotor to operate and move the base element laterally relative to the belt sleeve a distance corresponding to a desired width of an individual belt to be cut from the belt sleeve.

A mandrel may be provided that is selectively abuttable to at least one of the pulleys to reduce vibrations caused by the belt sleeve moving around the first and second pulleys.

In one form, the camera has an imaging pickup area with a center line and the cutting edge substantially coincides laterally relative to the sleeve with the cutting edge with the cutting edge engaged with the belt sleeve at the predetermined cutting location.

In one form, the belt sleeve has a plurality of endless grooves formed therein through a surface which is exposed with the belt sleeve trained around the support subassembly, the cutting edge is arranged to engaged the belt sleeve trained around the support assembly, the cutting subassembly includes at least one cylinder for advancing the cutting edge against and through the belt sleeve, the base element is guided in translation in a lateral direction relative to the belt sleeve trained around the support subassembly, the cutting edge and the at least one cylinder move with the base element in a lateral direction relative to the sleeve, the imaging subassembly has an imaging pickup area with the center line, and the predetermined cutting location is aligned laterally relative to the belt sleeve with a center line of the imaging pickup area.

The invention is also directed to a method of cutting an individual belt of a predetermined width from a belt sleeve having a width greater than the predetermined width using an apparatus having a support subassembly, a cutting subassembly including a cutting edge, an imaging subassembly, and a control system. The method involves the steps of training the belt sleeve around a part of the support subassembly, providing an image of a preferred relationship between the cutting edge and the predetermined cutting location along the width of the belt sleeve, through the imaging subassembly generating an image of the actual relationship between the cutting edge and the predetermined cutting location along the width of the belt sleeve, comparing the images of the preferred and actual relationships between the cutting edge and the predetermined cutting location along the width of the belt sleeve to determine a widthwise deviation between the preferred and actual relationships between the cutting edge and the predetermined cutting location along the width of the belt sleeve, based on the determined widthwise deviation repositioning the cutting edge widthwise relative to the belt sleeve to reduce the determined widthwise deviation, and after repositioning the cutting edge advancing the cutting edge into the belt sleeve trained around the part of the support subassembly.

The method may further include the step of moving the belt sleeve in an endless path as the cutting edge is advanced into the belt sleeve.

The method may further include the step of advancing a mandrel against the part of the support assembly to reduce vibration caused by the belt sleeve moving in the endless path.

The method may further include the steps of advancing the cutting edge fully through the belt sleeve to cut the individual belt from the belt sleeve and repositioning the cutting edge widthwise relative to the belt sleeve a distance corresponding to the predetermined width to a second predetermined location after cutting the individual belt from the belt sleeve.

The method may further include the steps of generating an image of the actual relationship between the cutting edge and a second predetermined cutting location, comparing the image of the preferred relationship to the image of the actual relationship between the cutting edge and the second predetermined cutting location to determine a second widthwise deviation between the preferred relationship and the actual relationship between the cutting edge and the second predetermined cutting location.

The method may further include the step of repositioning the cutting edge relative to the belt sleeve to reduce the second widthwise deviation.

The cutting edge may be advanced fully through the belt sleeve at the second predetermined cutting location.

The method may further include the step of repositioning the imaging subassembly widthwise relative to the belt sleeve before the cutting edge is repositioned widthwise relative to the belt sleeve toward the second predetermined cutting location.

BRIEF DESCRIPTION THE DRAWINGS

DETAILED DESCRIPTION OF THE DRAWINGS

Figure 1:
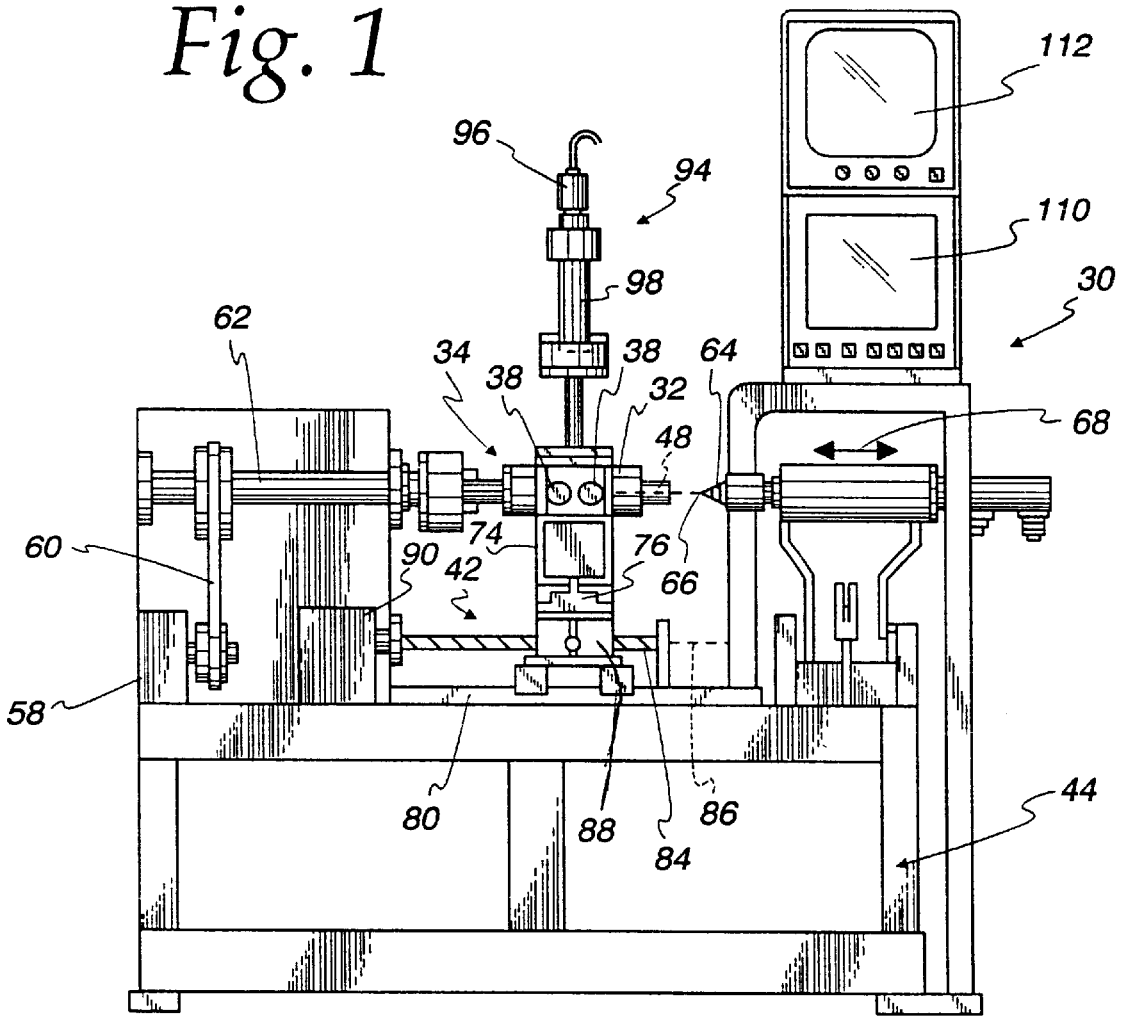
FIG. 1 is a front elevation view of a belt sleeve cutting apparatus, according to the present invention.
Figure 2:
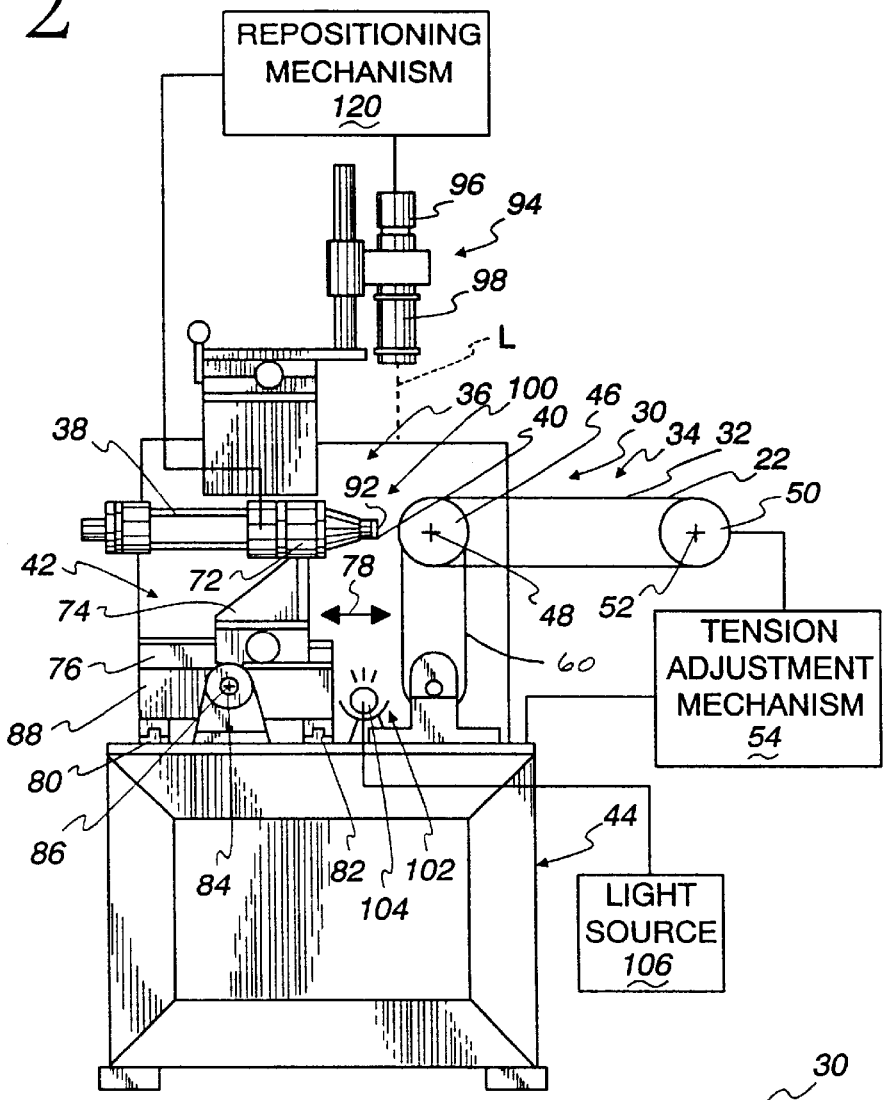
FIG. 2 is a side elevation view of the belt sleeve cutting apparatus in FIG. 1.
Figure 3:
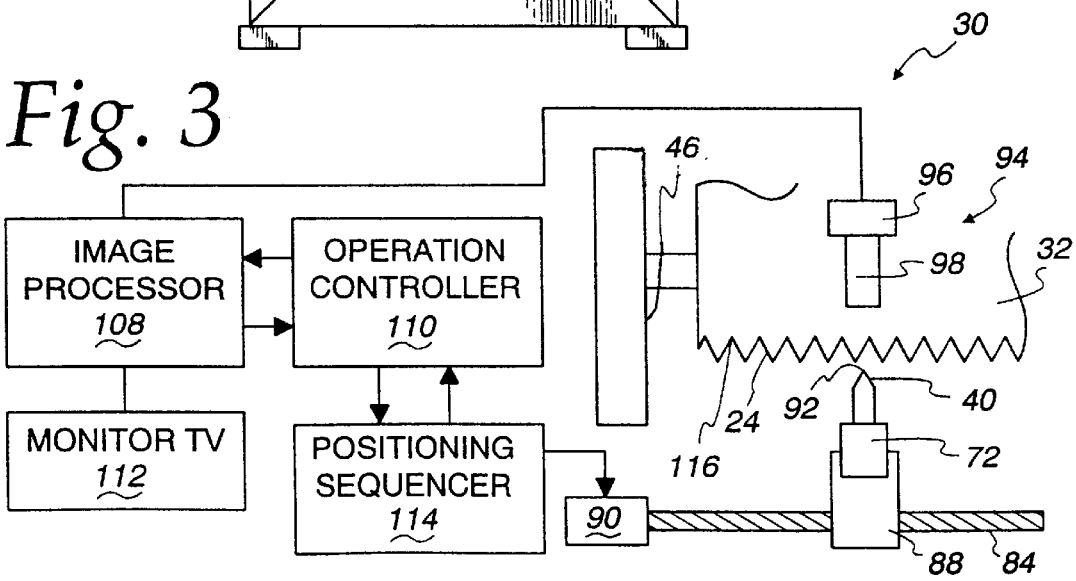
FIG. 3 is a schematic representation of the belt sleeve cutting apparatus in FIGS. 1 and 2.
Figure 6:
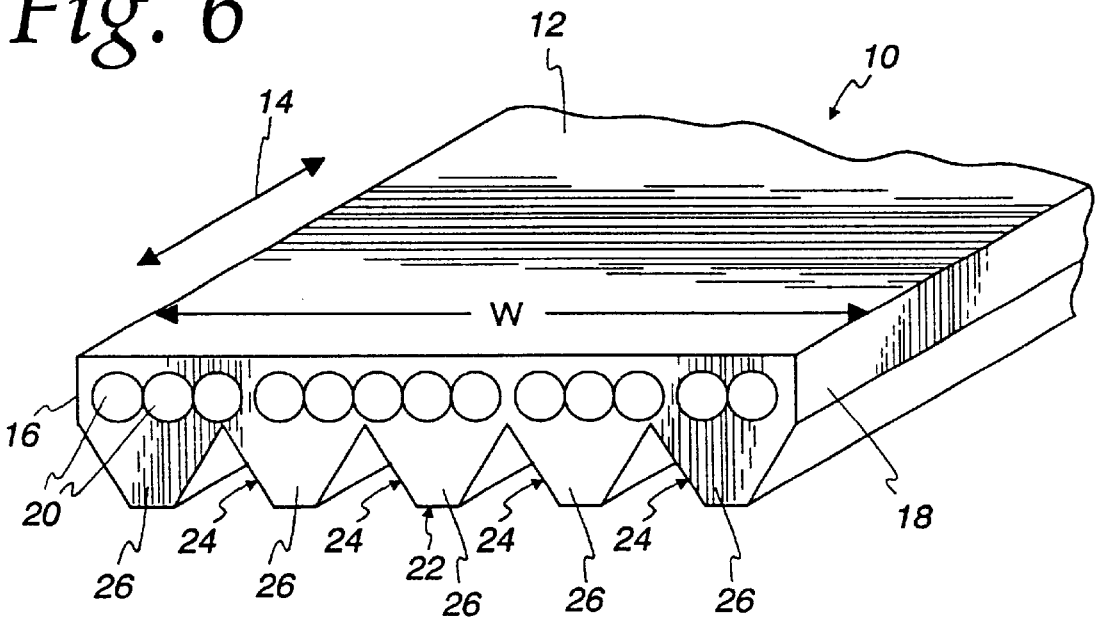
FIG. 6 is a fragmentary, perspective view of a multi-ribbed V-belt which can be made using the inventive apparatus and practicing the inventive method.

In FIGS. 1–3, a belt cutting apparatus, according to the present invention, is shown at 30. The belt cutting apparatus 30 is used to cut individual belts 10 (FIG. 6) from a belt sleeve 32. The primary components of the belt cutting apparatus 30 consist of a dynamic belt support subassembly 34 and a cutting subassembly 36 for operating on the belt sleeve 32 carried by the belt support subassembly 34. The cutting subassembly 36 includes air cylinders 38 for advancing a cutter 40 against and through the belt sleeve 32 on the belt support subassembly 34. The cutting subassembly 36 includes a cutter shifting mechanism 42 for moving the cutter 40 together with the air cylinder 38 in the widthwise direction of the belt sleeve 32, i.e. into and out of the page in FIG. 2 and from side-to-side in FIG. 1.

The belt support subassembly 34 is mounted upon a frame 44 and consists of a pulley 46 which rotates around an axis 48 and a spaced pulley 50 which rotates around an axis 52 that is spaced from and parallel to the axis 48. Through a tension adjustment mechanism 54, the relative spacing between the pulleys 46, 50 can be varied. With the belt sleeve 32 trained around the pulleys 46, 50, through the tension adjustment mechanism 54, the tension on the belt sleeve 32 can be selected.

The belt sleeve 32 is mounted so that the inside surfaces 22 of the belt 10 face outwardly. A motor 58 operates a belt 60 which rotates a drive shaft 62, with the shaft 62 in turn driving the pulley 46.

A mandrel 64, supported on the frame 44, has a cantilevered, conical end 66 which is concentric with the pulley axis 48. The mandrel 64 can be driven in the line of the double-headed arrow 68 selectively towards and away from the pulley 46. The mandrel 64, in contact with the pulley 46, reduces vibration of the rotating pulley 46 caused by the belt sleeve 32 moving in the endless path around the pulleys 46, 50.

The cutter 40 is carried on a cutter head 72 at the distal end of the air cylinders 38. The cutter head 72 is mounted on a carriage 74 which is in turn guided on a rail 76 in the direction of the double-headed arrow 78 selectively towards and away from the pulley 46.

The carriage 74 and guide rail 76 are guided upon a pair of spaced rails 80, 82 on the frame 44. The rails 80, 82 define a travel path for the carriage 74 that is substantially parallel to the rotary axes 48, 52 for the pulleys 46, 50, respectively.

A threaded shaft 84 is supported above and between the rails 80, 82, with the central axis 86 of the shaft 84 being parallel to the axes 48, 52 and the length of the rails 80, 82. The shaft 84 threadably engages a base element 88 which supports the carriage 74 and which is movable guidingly along the rails 80, 82. The shaft 84 is selectively rotated in opposite directions about its axis 86 through a reversible servomotor 90. By rotating the threaded shaft 84 in one direction, the base element 88, carriage 74, and cutter head 72 are caused to move away from the servomotor 90, whereas rotation oppositely to the one direction causes the same elements to move towards the servomotor 90.

The cylinders 38 are synchronized to cooperatively drive the cutter 40 in a linear path that is orthogonal to the pulley axis 48. A vertically extending cutting edge 92 on the cutter 40 resides midway between the air cylinders 38. By advancing the air cylinders 38, the cutting edge 92 can be brought into contact with and progressively urged against the belt sleeve 32 to cut through the thickness of the belt sleeve 32 on the belt support subassembly 34. With the belt sleeve 32 being driven around the pulley 46, 50, the cutting edge 92 effects a cut around the entire periphery of the belt sleeve 32.

Above the cutter head 72 and cutter 40 is an imaging subassembly 94, which includes a downwardly focused CCD camera 96 and a macrozoom lens 98. The camera 96 is preferably adjusted so that the center line L (FIG. 2) of an image pick up area at 100 beneath the camera 96 is aligned with the vertical cutting line for the cutting edge 92 on the cutter 40.

An illumination subassembly 102 is provided on the frame 44. The illumination subassembly 102 consists of an illumination element 104, which may be an optical fiber element which directs light from a source 106 upwardly to the image pick up area 100.

To control the position of the cutter 40 along the width of the belt sleeve 32 i.e. parallel to the axis 48 of the pulley 46, an image of the groove 24 on the belt sleeve 32 is generated through the camera 96 as the belt sleeve 32 is driven around the pulleys 46, 50. As seen in FIG. 3, the output of the camera 96 is sent to an image processor 108 for processing. An operation controller 110, which may include a personal computer, is operatively connected to the image processor 108 and located over the mandrel 64. A TV monitor 112 is placed immediately over the operation controller 110 and displays the image which is processed by the image processor 108.

The operation controller has a positioning sequencer 114 for controlling the servomotor 90 to reposition the base element 88, the carriage 74, the cutter head 72, and cutter 40. The operation controller 110 computes the moving distance of the cutter 40 using the image developed by the image processor 108 and uses this information to effect the necessary operation of the servomotor 90. By operating the servomotor 90 in a "forward" or "backward" direction, the shaft 84 rotates to shift the base element 88, carriage 74, cutter head 72 and cutter 40 so that the cutting edge 92 on the cutter 40 is precisely aligned at the base 116, i.e. at the base line or centerline, of the groove 24 at which the cut is to be effected.

The apparatus 30 operates as follows. The belt sleeve 32 is trained around the pulleys 46, 50 with the belt surfaces 22 facing outwardly, whereupon the pulley 50 is shifted through the tension adjustment mechanism 54 to produce the desired tension on the belt sleeve 32. The camera 96 and lens 98 are positioned, and each individually finely adjusted, so that the cutting edge 92 of the cutter 40 can be laterally aligned relative to the belt sleeve 32 on the center line L of the imaging subassembly 94. A standard value, which corresponds to the width W of the belt 10 to be produced, is set as the stepping distance for the cutting edge 92 i.e. the shift movement of the base element 88, carriage 74, cutter head 72 and cutter 40. The standard value is set on the basis of the pitch and the number of grooves 24 which are formed in the belt sleeve 32.

Figure 4:
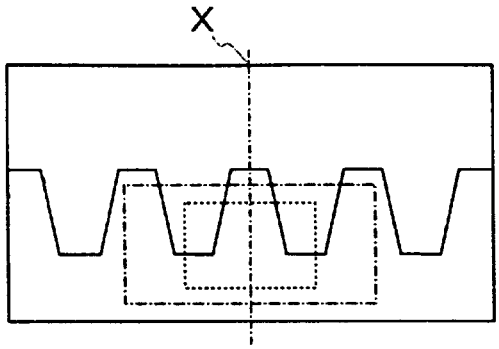
FIG. 4 is a schematic representation of an image showing the preferred relationship between a cutter on the belt sleeve cutting apparatus and a belt sleeve.

The base element 88 is manually shifted such that the image of the groove 24 at which cutting is to take place can be picked up by the camera 96. Once the image of the selected groove 24 is picked up, fine adjustment of the base element 88 is made to bring the base line 116 of the groove 24 into alignment with the center line L at the image pick up area 100. With the camera 96 finely adjusted, the image of the groove 24 at the cutting site is picked up and stored in the image processor 108. The image processor 108 stores the image as indicated by broken lines in FIG. 4. In the stored image, the center line 116 of the groove 24 is aligned with an image center line X so that the cutting edge 92 of the cutter 40 is on the image center line X.

In this state, the motor 58 simultaneously drives the pulley 46 and the air cylinders 38 so that the cutting edge 92 of the cutter 40 is advanced to the predetermined cutting location at the base/center line 116 of the groove 24 at which cutting occurs. As the belt sleeve 32 advances, cutting takes place over the entire peripheral extent of the sleeve 32 to define one side surface 16, 18 of the belt 10.

After this cutting occurs, the servomotor 90 is operated to slide the base element 88 laterally relative to the belt sleeve 32 a predetermined, pre-set distance. This causes the cutting edge 92 to be situated at the base of the rib which represents the other lateral side surface 18, 16 of the belt. At this stage, the operation controller 110 initiates correcting control of the cutter edge 92 through the servomotor 90. This is initiated by a signal sent by the operation controller 110 to the image processor 108.

Figure 5:
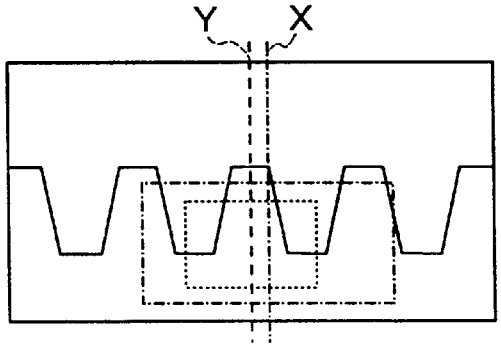
FIG. 5 is a view as in FIG. 4 with a camera image showing the actual relationship between the cutter and a belt sleeve.

The image processor 108, in response to this signal from the operation controller 110, causes the camera 96 to generate an image of the cutting edge 92 at the groove 24 that is at the new cutting site i.e. the actual lateral relationship between the cutting edge 92 and the groove 24 at the new, predetermined cutting location. The image processor 108 matches the new image with the stored image. In this case, as illustrated in FIG. 5, the area in the new image, as indicated by the double-dotted lines, is matched with the stored image, as indicated by broken lines. The deviation between the center line X of the stored image and the center line Y of the actual image is determined and relayed to the operation controller 110.

Within the image processor 108, the stored reference image of the center line 116 of the groove 24 is aligned with the center line of the stored image. The cutting edge 92 of the cutter 40 is positioned on the center line X of the stored image and the center line 116 of the groove 24. The deviation between the image center lines X and Y at the time that the comparison is made between the actual image showing the relationship between the center line 116 of the groove 24 at which cutting is to occur and the center line 116 of the stored groove image determines the deviation, laterally relative to the belt sleeve 32, between the center line 116 of the groove 24 at which cutting is to occur on the belt sleeve 32 and the cutting edge 92 of the cutter 40.

The image of the belt sleeve 32 is generated a pre-set number of times by the camera 96. Each time the image is picked up by the camera 96, the image processor 108 makes a comparison between the new/picked up image and the stored image and determines the deviation between the center line Y of the new image and the center line X of the stored image and outputs the result to the operation controller 110.

The operation controller 110 reads the coordinate data and deviation between the center line Y of the new image as sent from the image processor 108 and the center line X of the stored image and statistically processes the coordinate data, as read, to compute the optimum value of the deviation between the center line of the two images, that is the deviation between the center line 116 of the groove 24 at which cutting is to occur and the cutting edge 92 of the cutter 40. The operation controller 110 then converts the optimum value of the computer deviation into a distance value on the basis of the field of view of the camera 96 and determines the moving direction and distance of the cutting edge 92 required to eliminate the deviation. The operation controller 110 produces a signal corresponding to the directional distance deviation to the positioning sequencer 114. In response to the signal, the sequencer 114 activates the servomotor 90 forward or backward to shift the base element 88 a predetermined direction and a predetermined distance. As a result of this adjustment, the cutting edge 92 of the cutter 40 assumes a position at a predetermined location on the center line 116 of the groove 24 at which cutting is to occur on the belt sleeve 32.

As the centering occurs, the cylinders 38 are simultaneously driven to advance the cutting edge 92 of the cutter 40 against the belt sleeve 92 to cut fully through the belt sleeve 32. As the belt sleeve 32 continues to advance, a complete separation of a belt 10 of predetermined width takes place.

After the cutting edge 92 advances fully through the belt sleeve 32, the servomotor 90 is operated to shift the base element 88 a predetermined distance based on the standard value calculated from the widthwise size specification for the belt 10 to be manufactured. The above steps are repeated to serially remove individual belts 10 from the belt sleeve 32.

The belt cutting apparatus 30 can be used advantageously with any belt sleeve made from cast urethane elastomer or a rubber elastomer, that may be one, or a mixture of, natural rubber, butylene rubber, styrene-butadiene rubber, chloroprene rubber, ethylene-propylene rubber, hydrogenated nitrile rubber, or alkylated chlorosulfonated polyethylene. The inventive concept can be employed with belts having other compositions.

Additionally, while the apparatus 30 has been described with respect to the formation of a multi-ribbed V-belt, the invention can be effectively used in processes in which repetitive cutting of identical shapes takes place, which is facilitated by image comparison. As an example, the apparatus could be employed in the manufacture of a belt for a printer, such as one with pin-shaped projections, or a conveyor belt having cross pieces on a conveying surface thereon.

The invention makes possible the accurate alignment of a cutting edge on a cutter on a center line at the base of a groove. It is possible to automatically make periodic adjustments to compensate for any deviation in the relationship between the cutting edge and center line of the groove base at which cutting is to be carried out. The invention makes it possible to avoid fine cutter adjustments as are commonly manually carried out in prior art manufacturing operations. The operator may make an initial set up, whereupon the apparatus manually adjusts itself to quickly, efficiently and consistently locate a cutting edge on a cutter at a predetermined cutting location along the width of a belt sleeve.

One modification to the apparatus 10 is shown in FIG. 2 wherein a repositioning mechanism 120 is utilized to move the imaging subassembly 94 laterally relative to the belt sleeve 32 as the cutting edge 92 is cutting the belt sleeve 32. This allows the imaging subassembly 94 to prepare to monitor the second predetermined cutting location as cutting takes place at the first location, which might possibly reduce the cycle time for the system.

The foregoing disclosure of specific embodiments is intended to be illustrative of the broad concepts comprehended by the invention.

What is claimed is:

1. A cutting system comprising:

a belt sleeve comprising a body with a width between laterally spaced sides and which is to be cut at a predetermined cutting location on the body to form an individual belt;

a support subassembly around which the belt sleeve is trained;

a cutting subassembly comprising a cutter having a cutting edge to engage and cut the belt sleeve at the predetermined cutting location, the cutting subassembly further comprising a base element which carries the cutter and which is repositionable to move the cutting edge in a lateral direction relative to the belt sleeve;

an imaging subassembly for generating an image of the actual lateral relationship between the cutting edge and the predetermined cutting location; and a control system for a) comparing the image of the actual lateral relationship between the cutting edge and the predetermined cutting location to a reference image showing a preferred lateral relationship between the cutting edge and the predetermined cutting location b) determining a deviation between the actual lateral relationship between the cutting edge and the predetermined cutting location and the preferred lateral relationship between the cutting edge and the predetermined cutting location, and c) generating a signal indicative of the deviation which can be processed to cause the base element to be repositioned to reduce the deviation between the actual lateral relationship between the cutting edge and the predetermined cutting location and the preferred lateral relationship between the cutting edge and the predetermined cutting location.

2. The cutting system according to claim 1 wherein the support subassembly comprises first and second spaced pulleys around which the belt sleeve is trained and a drive for causing the belt sleeve to move in an endless path around the first and second pulleys.

3. The cutting system according to claim 2 further comprising a mandrel that is abuttable to at least one of the pulleys to reduce vibrations caused by the belt sleeve moving around the first and second pulleys.

4. The cutting system according to claim 1 wherein the imaging subassembly comprises a camera and there is a monitor for displaying the image of the actual lateral relationship between the cutting edge and the predetermined cutting location generated by the camera.

5. The cutting system according to claim 4 wherein the camera has an imaging pickup area with a center line and the cutting edge is aligned with the center line of the image pickup area laterally with respect to the belt sleeve.

6. The cutting system according to claim 4 wherein the cutting edge and camera are movable as one piece laterally relative to the belt sleeve.

7. The cutting system according to claim 4 wherein the camera has an imaging pickup area with a center line and the cutting edge substantially coincides laterally relative to the belt sleeve with the cutting edge with the cutting edge engaged with the belt sleeve at the predetermined cutting location.

8. The cutting system according to claim 1 wherein the cutting subassembly comprises at least one cylinder for advancing the cutting edge against and through the belt sleeve.

9. The cutting system according to claim 1 wherein the belt sleeve body comprises a plurality of ribs including first and second ribs with a V-shaped groove between the first and second ribs, the V-shaped groove has a base and the predetermined cutting location is at the base of the V-shaped groove.

10. The cutting system according to claim 1 wherein the cutting subassembly comprises a servomotor operable in a forward direction and a reverse direction to thereby selectively cause the base element to reposition in first and second opposite lateral directions relative to the belt sleeve and the servomotor is operable in response to the signal generated by the control system.

11. The cutting system according to claim 10 wherein the control system comprises a positioning sequencer for generating a signal that causes the servomotor to operate and move the base element laterally relative to the belt sleeve a distance corresponding to a desired width of an individual belt to be cut from the belt sleeve.

12. The cutting system according to claim 1 wherein the belt sleeve has a plurality of endless grooves formed therein through a surface which is exposed with the belt sleeve trained around the support subassembly, the cutting edge is arranged to engage the belt sleeve trained around the support subassembly, the cutting subassembly comprises at least one cylinder for advancing the cutting edge against and through the belt sleeve, the base element is guided in translation in a lateral direction relative to the belt sleeve trained around the support subassembly, the cutting edge and the at least one cylinder move with the base element in the lateral direction relative to the sleeve, the imaging subassembly has an imaging pickup area with a center line, and the predetermined cutting location is aligned laterally relative to the belt sleeve with the center line of the imaging pickup area.

* * * * *